US008443882B2

(12) United States Patent
Barnard et al.

(10) Patent No.: US 8,443,882 B2
(45) Date of Patent: May 21, 2013

(54) WELLBORE CENTRALIZER FOR TUBULARS

(75) Inventors: Jason J. Barnard, Katy, TX (US); Donald N. Horner, Spring, TX (US); Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 281 days.

(21) Appl. No.: 12/831,770

(22) Filed: Jul. 7, 2010

(65) Prior Publication Data

US 2012/0006533 A1 Jan. 12, 2012

(51) Int. Cl.
*E21B 17/10* (2006.01)

(52) U.S. Cl.
USPC ..... 166/241.6; 166/241.4; 175/325.5

(58) Field of Classification Search
USPC ..... 166/241.6, 241.4; 175/325.5
See application file for complete search history.

(56) References Cited

U.S. PATENT DOCUMENTS

| | | | | |
|---|---|---|---|---|
| 2,228,649 | A | 1/1941 | Welles | |
| 2,605,844 | A | 8/1952 | Clark, Jr. | |
| 2,845,128 | A | 7/1958 | Clark, Jr. et al. | |
| 2,849,071 | A | 8/1958 | Park | |
| 3,145,785 | A * | 8/1964 | Kellner | 175/73 |
| 3,351,136 | A * | 11/1967 | Nelson | 166/173 |
| 4,182,424 | A | 1/1980 | Prebensen | |
| 4,531,582 | A | 7/1985 | Muse et al. | |
| 4,641,776 | A | 2/1987 | Vlasek et al. | |
| 4,938,299 | A | 7/1990 | Jelsma | |
| 5,797,455 | A * | 8/1998 | Barron et al. | 166/241.6 |
| 5,908,072 | A | 6/1999 | Hawkins | |
| 5,937,948 | A * | 8/1999 | Robbins, III | 166/380 |
| 6,725,939 | B2 | 4/2004 | Richard | |
| 7,071,697 | B2 * | 7/2006 | Rioufol et al. | 324/366 |
| 7,159,668 | B2 | 1/2007 | Herrera | |
| 7,377,325 | B2 * | 5/2008 | Trinder et al. | 166/382 |
| 7,422,069 | B2 | 9/2008 | Richard et al. | |
| 7,559,371 | B2 * | 7/2009 | Lynde et al. | 166/298 |
| 7,624,798 | B2 | 12/2009 | Presslie et al. | |
| 7,708,063 | B2 | 5/2010 | Palmer | |
| 7,775,272 | B2 * | 8/2010 | Nelson et al. | 166/241.6 |
| 2002/0139537 | A1 * | 10/2002 | Young et al. | 166/378 |
| 2004/0178797 | A1 * | 9/2004 | Rioufol et al. | 324/367 |
| 2005/0241822 | A1 * | 11/2005 | Gremillion | 166/241.6 |
| 2007/0181298 | A1 * | 8/2007 | Sheiretov et al. | 166/212 |
| 2008/0115972 | A1 * | 5/2008 | Lynde et al. | 175/57 |
| 2008/0223573 | A1 * | 9/2008 | Nelson et al. | 166/241.6 |
| 2010/0078173 | A1 * | 4/2010 | Buytaert et al. | 166/302 |
| 2012/0006533 | A1 * | 1/2012 | Barnard et al. | 166/241.1 |

* cited by examiner

*Primary Examiner* — Jennifer H Gay
(74) *Attorney, Agent, or Firm* — Steve Rosenblatt

(57) ABSTRACT

A tubular centralizer is secured to the tubular for run in. The profile for run in is small so that damage to the centralizer is minimized during run in. When the string is in position the centralizer is actuated to change shape or volume to engage the surrounding borehole to centralize the tubular for subsequent operations such as cementing or in the case of screens for gravel packing. The centralizer can be a shape memory material that is initially compressed at above its transition temperature to hold the smaller shape. At the desired location after run in it is brought above the transition temperature and changes back to the original shape or volume to centralize the tubular string. The structure can be spaced ring segments or a cohesive ring structure with an undulating profile or radiating blades to create flow spaces in the annulus where it is deployed for flow of a sealing material or gravel, for example.

19 Claims, 1 Drawing Sheet

WELLBORE CENTRALIZER FOR TUBULARS

FIELD OF THE INVENTION

The field of the invention is centralizers for tubulars and more particularly centralizers that change configuration from a smaller profile for run in to a larger profile when in position to centralize a tubular for an operation such as cementing.

BACKGROUND OF THE INVENTION

Centralizers have been used for a long time for positioning a string in a subterranean location so that a sealing material such as cement can flow around it and can have a uniform thickness over the length of the cement job for greater sealing integrity between portions of a formation and the string passing through a borehole.

There have been a variety of techniques to centralize pipe including both structures added to the pipe and scoring and folding the pipe itself to form a centralizer as illustrated in U.S. Pat. No. 7,708,063. Usually, a pair of rings separated by bow springs is used and the structure is either slipped over the pipe on assembly of a string or is clamped to the pipe in the assembly process using end rings that are hinged so that they can be opened to mount to the pipe and then closed and secured over the pipe. Some examples are U.S. Pat. Nos. 4,641,776 and 4,531,582. Some designs were non-metallic sleeves that gave way when the string was internally expanded in the subterranean location such as U.S. Pat. No. 6,725,939. In other cases radially telescoping members were extended when the string was in the desired location to centralize the string as shown in U.S. Pat. No. 7,422,069. In U.S. Pat. No. 7,559,371 a centralizer was delivered through tubing and set itself in the casing below the tubing so that a central passage through the centralizer was aligned with a whipstock ramp. The milling string would pass through tubing and would be guided by the centralizer to stay on the whipstock ramp during window milling for a lateral. The centralizer was made of shape memory alloy and its reversion to an original shape allowed it to get a grip on a surrounding casing after passing through a narrower tubing string. In another design for a centralizer that accommodated expansion there were overlapping segments that had play so that the centralizer could grow with the internally expanded tubular, as shown in U.S. Pat. No. 7,624,798. Other older designs for centralizers are seen in U.S. Pat. Nos. 2,845,128; 2,849,071; 2,605,844 and 2,228,649. Rubber sleeves have been used in surface drilling equipment to centralize a drill string as shown in U.S. Pat. No. 4,182,424. Rubber or plastic sleeves with blades that are rigid enough to take the impacts during string delivery have been used as illustrated in U.S. Pat. Nos. 4,938,299; 7,159,668 and 5,908,072.

Centralizer present problems for the string being run in as parts of the centralizer can get hung up on shoulders or casing joints or landing collars. If pieces break off the centralizers the possibility exists that the string can get struck or that if the string is delivered successfully that the centralizers will not do their function of placement of the tubular for such operations as cementing or in the case of screens for gravel packing. It is therefore advantageous to have a centralizer that can change in dimension or volume as between run in and at full deployment of the string. The present invention envisions the use of such a design where the centralizer has a lower profile during run in and is then able to be configured when at location to serve as a tubular centralizer. In the preferred embodiment using a series of spaced shapes attached to the tubular outer wall and made from a shape memory alloy, polymer or foam. The material in its initial state is large enough to engage the wellbore wall when on location. Prior to mounting the material to the tubular it is heated above its transition temperature and compressed to a smaller shape and allowed to cool while compressed to retain the compressed shape. On location where the temperature is or is raised to above the transition temperature, the segments assume their original shape and volume so that the segments wind up in a supporting position for the tubular in a centralized manner. These and other aspects of the present invention will be more apparent to those skilled in the art by a review of the description of the preferred embodiment and associated drawings while understanding that the full scope of the invention is given by the appended claims.

SUMMARY OF THE INVENTION

A tubular centralizer is secured to the tubular for run in. The profile for run in is small so that damage to the centralizer is minimized during run in. When the string is in position the centralizer is actuated to change shape or volume to engage the surrounding borehole to centralize the tubular for subsequent operations such as cementing or in the case of screens for gravel packing. The centralizer can be a shape memory material that is initially compressed at above its transition temperature to hold the smaller shape. At the desired location after run in it is brought above the transition temperature and changes back to the original shape or volume to centralize the tubular string. The structure can be spaced ring segments or a cohesive ring structure with an undulating profile or radiating blades to create flow spaces in the annulus where it is deployed for flow of a sealing material or gravel, for example.

DETAILED DESCRIPTION OF THE PREFERRED EMBODIMENT

Figure 1:
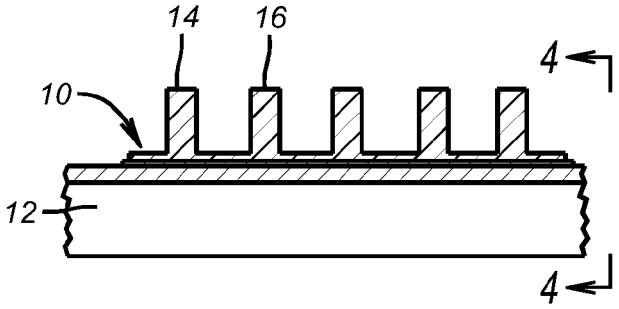
FIG. 1 is a section view of an initial shape of a centralizer before it is reshaped.
Figure 3:
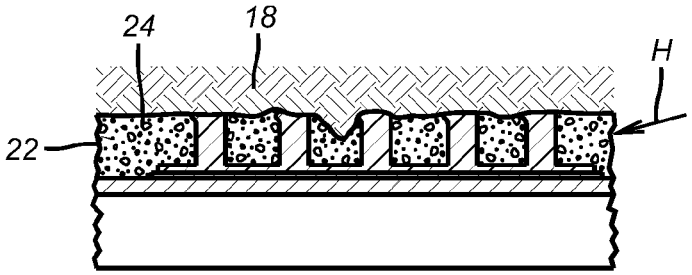
FIG. 3 is the centralizer of FIG. 1 after placement and exposure to heat that causes it to change back to the original shape or volume.
Figure 4:
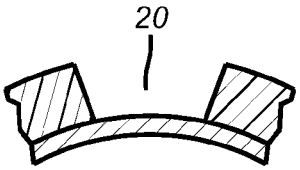
FIG. 4 is an end view of the centralizer of FIG. 1 showing an embodiment that is segmental.
Figure 5:
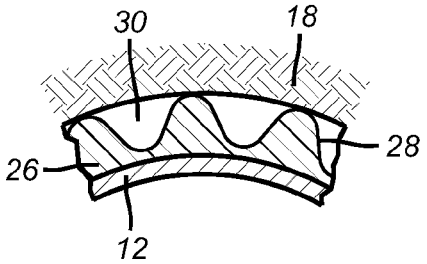
FIG. 5 is an end view of alternative design of the centralizer that is a ring structure with an outer undulating shape to let fluids or solids pass when its shape or volume reverts to the original and engages a wellbore.

FIG. 1 shows an initial shape of the centralizer 10 mounted on a tubular 12. In this embodiment there are parallel ribs 14, whose axial spacing can be even or uneven. Their radial extension to ends 16 should be long enough to engage the formation 18 as shown in FIG. 3 when the centralizer 10 regains its original shape or volume. Preferably the length to ends 16 should put each rib 14 into compressive loading against the formation 18. This result is best achieved with a shape memory alloy that has a higher capacity for enduring stress when raised past its transition temperature than shape memory polymers or shape memory foams that can also be used as the centralizer 10. As shown in FIG. 4 when using parallel or near parallel rounded ribs such as 14 there can be gaps 20 that are preferably aligned as between adjacent ribs 14 so that in applications where the annulus 22 is filled with cement 24, the cement 24 has an opportunity to flow and fill the spaces between the ribs 14 and to continue up or down the annulus 22 with minimal resistance. Alternatively to cement, the annulus could be filled with gravel such as in a sand control application using screens. Going around the circumference there can be more than a single gap and each or some ribs can be nothing more that circumferential segments spaced by gaps such as 20. As an alternative to using segments, the centralizer can be a continuous ring 26 that in section has an undulating profile 28 or a series of radially extending blades with axial gaps in between so that in either embodiment there is an axial passage 30 to allow material such as cement or sand control gravel to pass as the tubular 12 is held centered in the borehole with respect to the surrounding formation 18.

Figure 2:
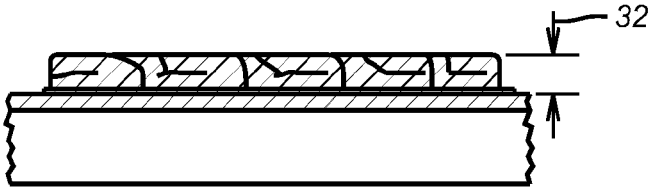
FIG. 2 is a reshaped version of the centralizer that has been compacted above its critical temperature so that the new shape is retained.

The initial shape and volume of FIG. 1 is compressed at a temperature above the transition temperature followed by lowering the temperature while holding the compressive force. As a result the shape and volume of FIG. 2, a cylindrical sleeve with a constant outer diameter and ribs 14 folded into the shape, is achieved for run in where the profile or height 32 is much lower so that the tubular 12 can be run in with reduced issues with clearance or damage to the centralizer 10. Once on location, heat can be applied externally or simply the well fluid temperature may be high enough for crossing the transition temperature, all schematically indicated by arrow H, so that the centralizer 10 will revert back to the original shape of FIG. 1 and will grow to meet the formation 18 to centralize the tubular 12 before the next procedure such as cementing or gravel packing, for example, takes place.

Those skilled in the art will appreciate that a random array of blocks of shape memory material can be used that are disposed about the outer periphery of the tubular 12. The spacing and total number of blocks will vary with the tubular size and weight per foot as well as the flow characteristics of the material that will be deposited in the spaces among the blocks in the annulus 22.

Materials that change shape or volume other than shape memory materials can be used such as rubber that swells in the presence of hydrocarbons or clays such as bentonite that swell and harden in the presence of water. However, these materials will grow to assume the borehole shape while potentially still leaving the tubular off center or simply laying on bottom in a horizontal run. The shape memory materials are preferred as they revert to a known original shape and create stresses in an effort to make that reversion so as to have an ability to actually shift the tubular to a more centralized position as the reversion process takes effect. Additionally, if the external heat source H is being used then the timing of the reversion process can be controlled so that it does not start as the tubular 12 is being delivered. Heat from the setting cement is also a possible heat source however it is preferred to get the centralizer assembly 10 into contact with the formation 18 prior to cement introduction to insure the proper placement for a good cement job.

If the shape memory materials are applied to the tubular in block form they can be held with adhesive, welding or other types of fasteners. The gaps for annular material such as cement or gravel can also be paths for fiber optic, electrical or hydraulic conduits for operation of other equipment supported by the tubular string 12.

The above description is illustrative of the preferred embodiment and many modifications may be made by those skilled in the art without departing from the invention whose scope is to be determined from the literal and equivalent scope of the claims below.

We claim:

1. A combination for subterranean use, comprising:

a tubular having an outer surface;

a centralizer supported by said outer surface having an element that centralizes, said element initially in contact along its length with said outer surface and having a smaller peripheral dimension when the tubular is run to the subterranean location and said element self actuating to a larger peripheral dimension by moving relatively away from said outer surface to centralize said tubular to a surrounding wellbore wall when located at a predetermined subterranean location;

said centralizer transitions between said smaller and larger dimension exclusively in response to reaching a predetermined temperature.

2. The combination of claim 1, wherein:

said centralizer engages a formation at the subterranean location in said larger peripheral dimension leaving a compressive stress in said centralizer.

3. The combination of claim 2, wherein:

said centralizer leaves gaps in an annulus between said tubular and the formation in said larger peripheral dimension.

4. The combination of claim 3, wherein:

said centralizer comprises a plurality of spaced apart segments leaving passages between them.

5. The combination of claim 4, wherein:

said segments are distributed around the outside diameter of said tubular in a random or symmetrical array.

6. The combination of claim 3, wherein:

said centralizer comprises a ring around said outer surface of said tubular having radially extending members.

7. The combination of claim 2, wherein:

said centralizer is formed at least in part from a shape memory material.

8. The combination of claim 7, wherein:

said shape memory material comprises an alloy, polymer or a foam.

9. The combination of claim 7, wherein:

said shape memory material is brought to said smaller dimension from said larger dimension, when mounted to said tubular before being run in, with a combination of compressive force and a temperature above said shape memory material transition temperature with said compressive force maintained as said centralizer temperature is reduced below said transition temperature.

10. The combination of claim 9, wherein:

said centralizer reverts to said larger dimension from exposure to fluids at the subterranean location.

11. The combination of claim 9, wherein:

said centralizer reverts to said larger dimension from heat added at the subterranean location.

12. The combination of claim 7, wherein:

said material changes shape or volume between said smaller and larger dimensions.

13. The combination of claim 1, wherein:

said tubular comprises a string of joints and said centralizer is disposed on a plurality of said joints.

14. The combination of claim 13, wherein:

said centralizer is formed at least in part from a shape memory material.

15. A combination for subterranean use, comprising:

a tubular having an outer surface;

a centralizer assembly supported by said outer surface having a smaller peripheral dimension when the tubular is run to the subterranean location and a larger peripheral dimension when located at a predetermined subterranean location;

said centralizer assembly engages a formation at the subterranean location in said larger peripheral dimension leaving a compressive stress in said centralizer;

said centralizer assembly leaves gaps in an annulus between said tubular and the formation in said larger peripheral dimension;

said centralizer assembly comprises a ring around said outer surface of said tubular having radially extending members;

said members are disc shaped and axially spaced from each other.

16. The combination of claim 15, wherein:

said discs are circumferentially discontinuous leaving gaps.

17. The combination of claim 16, wherein:

said gaps are axially aligned.

18. The combination of claim 6, wherein:

said radially extending members have an axis aligned with an axis of said tubular and define passages therebetween.

19. A combination for subterranean use, comprising:

a tubular having an outer surface;

a centralizer assembly supported by said outer surface having a smaller peripheral dimension when the tubular is run to the subterranean location and a larger peripheral dimension when located at a predetermined subterranean location;

said centralizer assembly engages a formation at the subterranean location in said larger peripheral dimension leaving a compressive stress in said centralizer;

said centralizer assembly leaves gaps in an annulus between said tubular and the formation in said larger peripheral dimension;

said centralizer assembly comprises a ring around said outer surface of said tubular having radially extending members;

said radially extending members are formed by an undulating exterior surface of peaks and valleys where said valleys define axial passages between said peaks.

* * * * *